US006524148B2

(12) United States Patent
Yoshigasaki et al.

(10) Patent No.: US 6,524,148 B2
(45) Date of Patent: Feb. 25, 2003

(54) OUTBOARD MARINE DRIVE INCLUDING AN ENGINE UNDER COVER MADE OF PLASTIC MATERIAL

(75) Inventors: Tsuyoshi Yoshigasaki, Tokyo (JP); Shinichi Ide, Tokyo (JP); Shoichi Rinzaki, Tokyo (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/052,680

(22) Filed: Jan. 17, 2002

(65) Prior Publication Data

US 2002/0098750 A1 Jul. 25, 2002

(30) Foreign Application Priority Data

Jan. 19, 2001 (JP) ..... 2001-011806
Jan. 19, 2001 (JP) ..... 2001-011817
Jan. 19, 2001 (JP) ..... 2001-011832
Jan. 19, 2001 (JP) ..... 2001-011836

(51) Int. Cl.[7] ..... B63H 20/32
(52) U.S. Cl. ..... 440/77
(58) Field of Search ..... 440/76, 77, 78; 123/195 P

(56) References Cited

U.S. PATENT DOCUMENTS 4,952,180 A * 8/1990 Watanabe et al. ..... 123/195 C
4,955,836 A * 9/1990 Suzuki et al. ..... 440/77
4,968,276 A * 11/1990 Hashimoto ..... 123/195 P
5,069,643 A * 12/1991 Westberg et al ..... 123/195 P
5,096,208 A * 3/1992 Westberg ..... 123/195 P
5,407,372 A * 4/1995 Mondek et al. ..... 440/52

FOREIGN PATENT DOCUMENTS

| | | |
|---|---|---|
| JP | 59-54400 | 4/1984 |
| JP | 5-85484 | 4/1993 |
| JP | 10-175595 | 6/1998 |

OTHER PUBLICATIONS

Patent Abstracts of Japan, http://wwwl.ipdl.jpo.go.jp/PA1/result/detail/main/wAAAa09850DA405085484P1.htm.
Patent Abstracts of Japan, http://www1.ipdl.jpo.go.jp/PA1/result/detail/main/wAAAa09850DA410175595P1.htm.

* cited by examiner

*Primary Examiner*—Stephen Avila
(74) *Attorney, Agent, or Firm*—MacPherson Kwok Chen & Heid LLP

(57) ABSTRACT

In an outboard marine drive, an engine is supported on an engine mount case, and an under cover made of plastic material having a lower end attached to the engine mount case defines an open upper end which engages an open lower end of an engine cover also made of plastic material. A metallic stay member having a lower end fixedly attached to the engine mount case which is typically made of cast aluminum alloy and an upper end fixedly supporting a support rail reinforces the open upper end of the under cover. Thus, the essential part is reinforced by a metallic member, and the required mechanical strength can be achieved while minimizing the increase in weight. The upper end of the stay member may be used for attaching a latch unit for securing the engine cover to the under cover or the engine mount case.

18 Claims, 8 Drawing Sheets

OUTBOARD MARINE DRIVE INCLUDING AN ENGINE UNDER COVER MADE OF PLASTIC MATERIAL

TECHNICAL FIELD

The present invention relates to an outboard marine drive, and in particular to an outboard marine drive including an under cover and an engine cover for jointly defining an engine room both of which are made of plastic material.

BACKGROUND OF THE INVENTION

An outboard marine drive typically defines a laterally narrow profile in a submerged part thereof to minimize the flow resistance, and a laterally broadest profile in a part where the under cover and engine cover are joined to each other to define an engine room therein. In such an outboard marine drive, it is desirable to form the under cover and engine cover with plastic material so as to minimize the weight of the outboard marine drive. However, to enable the outboard drive to support its own weight when placed on one side thereof, it is necessary to increase the thickness of the broad part thereof. However, this prevents the minimization of the weight of the outboard marine drive.

Also, a latch device is necessary for retaining the engine cover in the closed state. When the under cover is made of plastic material, it is required to be reinforced so as to be able to support the lock and/or latch device. This also prevents the minimization of the weight of the outboard marine drive.

The engine of the outboard marine drive is typically mounted on an engine mount case, for instance, made of aluminum alloy and provided with a high rigidity. Therefore, it is conceivable to resolve the problem of mechanical strength by forming the under cover integrally with the engine mount case.

However, the engine cover is required to have an open lower end of a relative large area so as to cover an upper part of the engine while permitting a favorable access to the engine when removed, and the under cover is required to have a correspondingly large open upper end which is adapted to engage the open lower end of the engine cover so as to jointly define an engine room. Therefore, if the under cover is made of metallic material, the weight of the outboard marine drive increases to an unacceptable level which would impair the handling such as transportation. In particular, as the size of the engine increases for an improved performance, the resulting increase in the overall weight of the outboard marine drive makes this problem all the more serious.

In larger outboard marine drives, the engine cover inevitably becomes large in size, and is required to be attached to the under cover or the engine mount case evenly at a plurality of points provided along the periphery of the lower open end of the engine cover. On the other hand, for servicing and other purposes, it is preferable to be able to remove the engine cover easily when required. Therefore, it is customary to provide a plurality of latch units along the periphery.

To eliminate the inconvenience of requiring to unlatch such latch units individually, it is preferable to provide a suitable synchronizing arrangement which enables a number of latch units to be unlatched simultaneously. Such latching arrangements have been proposed previously. For instance, Japanese patent laid open publication No.5-85484 discloses an arrangement in which a single inner cable actuates three latch units, Japanese patent laid open publication No.10-175595 discloses three hooks which are rotatable around horizontal shafts, one in a centrally front part and two on either side of a rear part, and Japanese utility model laid open publication No.59-54400 discloses an arrangement in which a pair of latch units are connected to each other by a Boden cable.

According to the proposal in Japanese patent laid open publication No.5-85484, because a single cable actuates all of the three latch units, a proper synchronization between the three latch units is not easy to achieve. Also, due to the absence of an outer tube for the actuation cable, the cable must extend substantially linearly between two of the latch units and the freedom in the layout of the latch units is limited so that an even pressure may not be applied to the seal member over the entire periphery of the engine cover.

According to the proposal in Japanese patent laid open publication No. 10-175595, the front and rear latch units must be released individually, and this inconvenience is not acceptable. Because the two hooks in the rear part are joined by a laterally extending rod, a laterally elongated space is necessary for passing the rod therethrough, and this severely limits the freedom in the layout of the latch units. This also prevents an even pressure to be applied to the seal member over the entire periphery of the engine cover.

According to the proposal in Japanese utility model laid open publication No. No.59-54400, the Boden cable extends along the inner surface of the engine cover, and it is difficult to adjust the tension of the cable so as to synchronize the actuation of the two latch units, and this work severely impairs the production efficiency and the ease of maintenance. This prior art reference does not teach how this proposal can be extended to the case where three or more latch units are required to be synchronized.

The lower edge of the engine cover engages the corresponding part of the engine under cover or the engine mount case via a seal rubber extending along the outer periphery of at least one of the two members which are to be joined to each other. During the closing and opening of the engine cover, the seal rubber tends to be excessively compressed each time the engine cover is attached in place, and this may cause a premature permanent deformation or other factors detrimental to the sealing performance of the seal rubber.

BRIEF SUMMARY OF THE INVENTION

In view of such problems of the prior art, a primary object of the present invention is to provide an outboard marine drive which can achieve both a light weight and a high mechanical strength substantially without any compromise.

A second object of the present invention is to provide an outboard marine drive which is light in weight and can be safely placed on one side thereof.

A third object of the present invention is to provide an outboard marine drive which is light in weight and allows a secure attachment of latch devices for the engine cover.

A fourth object of the present invention is to provide an outboard marine drive which is provided with an improved latching arrangement for the engine cover.

A fifth object of the present invention is to provide an outboard marine drive which is provided with an improved sealing performance for the engine cover.

According to the present invention, these objects can be accomplished by providing an outboard marine drive, comprising: an internal combustion engine; an engine mount case made of metallic material for supporting the engine; an extension case depending from the engine mount case and accommodating at least a part of a power transmission unit therein; an under cover made of plastic material for covering a lower part of the engine, the under cover having a lower end attached to an upper end of the engine mount case and an open upper end; an engine cover made of plastic material for covering an upper part of the engine, the engine cover having a substantially enclosed upper end and an open lower end which is adapted to engage the open upper end of the under cover to jointly define an engine room; and a stay member, preferably made of metallic material, attached to a part supporting the engine and provided with an upper end disposed adjacent to an upper end of the under cover. Typically, the stay member is provided with a lower end which is fixedly attached to the engine mount case which supports the engine. Thus, the essential part of the under cover is reinforced by a metallic member.

Preferably, the stay member includes at least two substantially upright members extending substantially upright along an inner surface of the under cover, and a support rail is integrally attached to upper ends of the upright members and extending along an upper edge of the under cover. Such an arrangement allows a maximum mechanical strength to be achieved with a minimum weight. Thus, the open upper end of the under cover is reinforced by the stay member, and a desired rigidity and mechanical strength can be achieved while minimizing the weight of the outboard marine drive.

The support rail preferably extends substantially straight along an inner surface of a side of the under cover, and is integrally attached to the upper ends of the upright members so that the upright members and support rail jointly provide an adequate mechanical strength to support the outboard marine drive when the outboard marine is placed on a corresponding side thereof.

According to a preferred embodiment of the present invention, the support rail extends in an arcuate manner along a rear part of the under cover so as to conform to an inner profile of the under cover, and the support rail extend between upper ends of the upright members. The support rail may simply extend along the inner surface of the under cover without being attached thereto, but may also be attached to the under cover by threaded bolts or other fasteners if desired.

The stay member may also be used for supporting a part of a latch unit for retaining the engine cover in a closed state. The latch unit as used herein shall mean any arrangement for detachably joining two parts including, not exclusively, hooks, locks and other similar arrangements. The latch unit is preferably provided with a means for defining the fully closed position of the engine cover so that the excessive deformation of the seal rubber provided along the lower edge of the engine cover may be avoided. If such an excessive deformation is repeated, the sealing performance of the seal rubber may be impaired in time. Defining the fully closed position of the engine cover can be readily accomplished by providing an abutting part on the latch unit for engaging a corresponding abutting part of the striker or the engine cover for defining a closed position of the engine cover. Preferably, a resilient member is interposed between the abutting surface and the abutting part of the striker or the engine cover for the purpose of accommodating errors in the relative positioning of the abutting surface and the corresponding abutting part and providing a cushioning property.

As the size of the engine cover increases, it becomes necessary to attach it to the engine mount case or the under cover by using a plurality of latch units arranged along the outer periphery of the engine mount case or the under cover. These latch units can be conveniently synchronized by using a rigid link member.

Such an embodiment of the present invention additionally comprises at least a pair of strikers provided in a lower end of the engine cover; a corresponding number of latch units provided in parts of the engine mount case corresponding to the strikers, each of the latch units including a latch plate provided on the engine mount case for rotation in a substantially horizontal plane between a position for engaging a corresponding one of the strikers and a position for disengaging the striker; and a link member having a first end pivotally connected to the latch plate of one of the latch units and a second end pivotally connected to the latch plate of a different one of the latch units so that the latch plate of the one latch unit causes a like movement of the latch plate of the different latch unit for a synchronized actuation of the latch units. If desired, it may further comprise an under cover having a lower end attached to the engine mount case, and an upper open end adapted to engage the open lower end, and a stay member having an upper end located adjacent to the open upper end of the under cover, at least one of the latch units being mounted to the upper end of the stay member.

Alternatively or additionally, the latching arrangement for the engine cover in an outboard marine drive according to the present invention may further comprise at least three strikers provided in a lower end of the engine cover; a corresponding number of latch units provided in parts of the engine mount case corresponding to the strikers, each of the latch units including a latch plate provided on the engine mount case for rotation between a position for engaging a corresponding one of the strikers and a position for disengaging the striker; and at least a first cable and a second cable, the first cable having one end connected to the latch plate of a first one of the latch units and an opposite end connected to the latch plate of a second one of the latch units, and the second cable having one end connected to the latch plate of the second latch unit and an opposite end connected to the latch plate of the third latch unit, the cables being guided along a inner peripheral part of the engine mount case.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
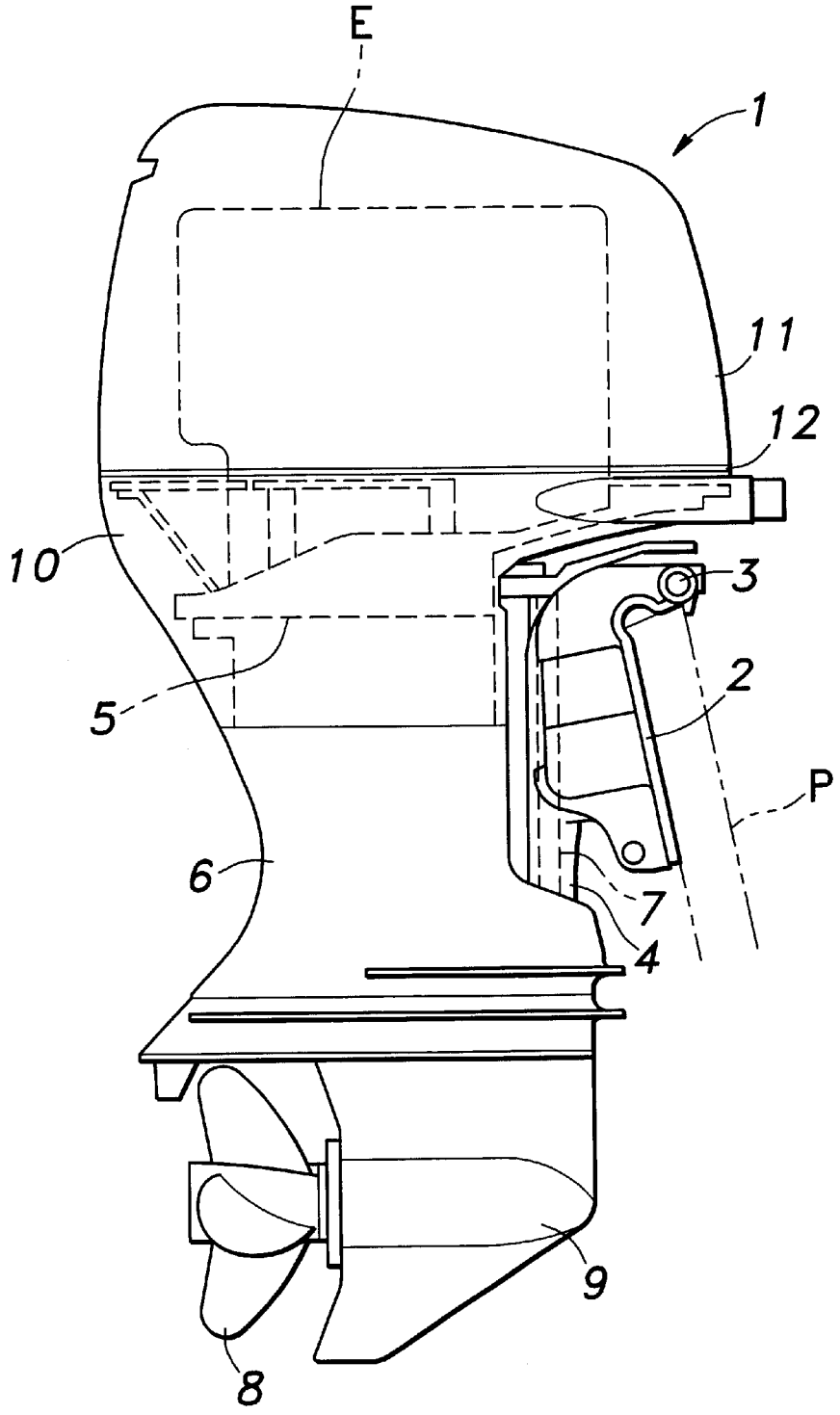
FIG. 1 is an external side view of an outboard marine drive embodying the present invention.

FIG. 1 is a side view showing the entire outboard marine drive embodying the present invention. This outboard marine drive 1 is adapted to be attached to the stern board P of a boat via a stem bracket 2.

To the stem bracket 2 is connected a swivel case 4 so as to be rotatable around a laterally extending tilt shaft 3. The swivel case 4 has an upper end which pivotally supports a front end of an engine mount case 5 and a lower end which pivotally supports an extension case 6 accommodating a part of a power transmission unit such as a drive shaft, so as to be rotatable around a vertically extending swivel shaft 7 in each case.

The upper end of the extension case 6 is connected to the engine mount case 5, and the lower end of the extension case 6 is connected to a gear case 9 supporting a propeller 8. The engine mount case 5 is covered by an under cover 10, and the upper end of the under cover 10 is fitted with an engine cover 11 defining a deep bowl shape having a lower open end in a detachable manner so as to cover, primarily, the upper part of the engine E which is mounted on the engine mount case 5.

A seal rubber 12 is interposed between the open ends of the under cover 10 and engine cover 11 to seal off water at the interface between the under cover 10 and engine cover 11, and the two parts are retained to each other by a latching arrangement (which is described hereinafter) provided adjacent to the interface between the two parts.

Figure 2:
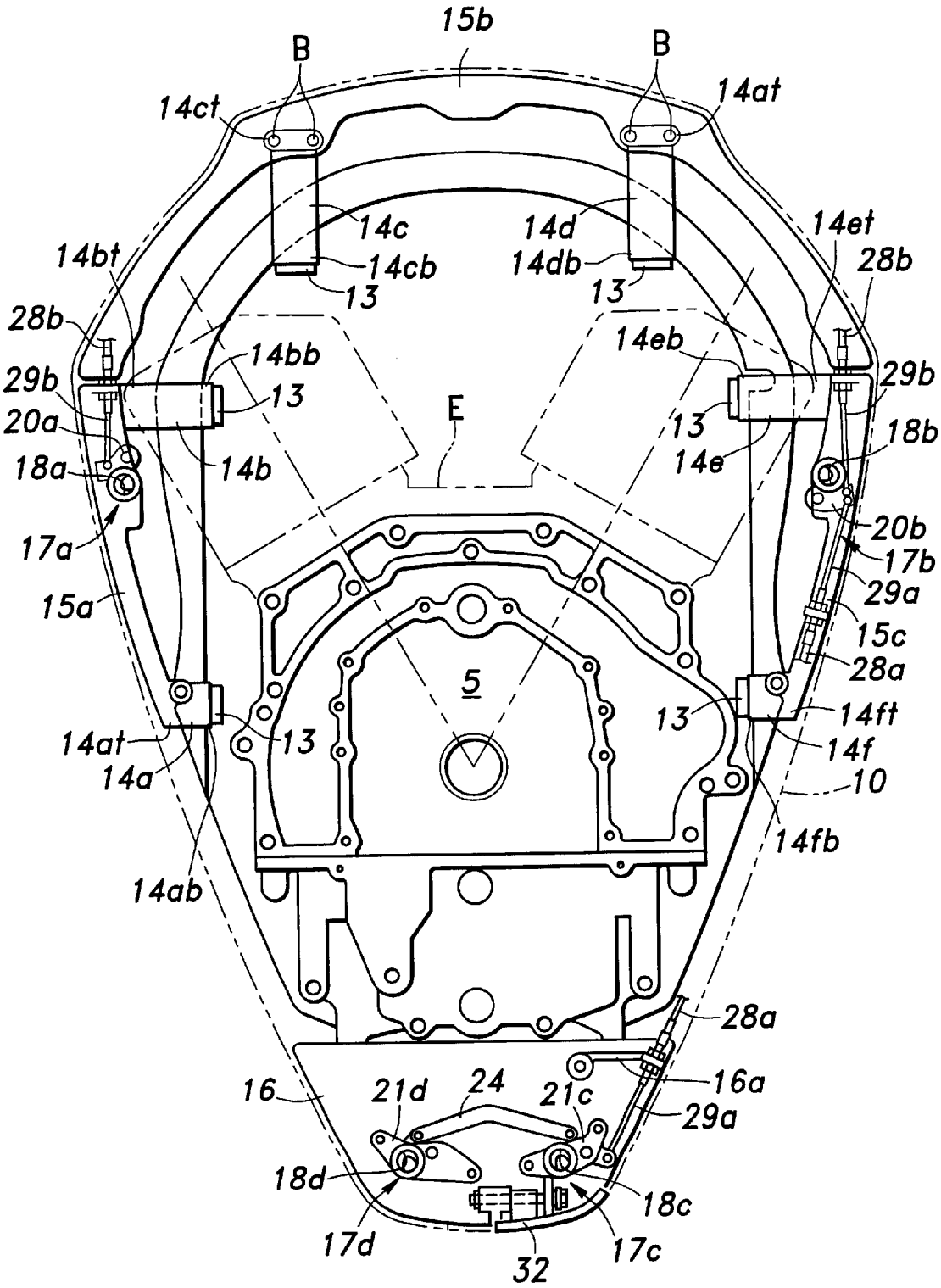
FIG. 2 is a simplified top view of the engine mount case revealing the mounting surface for the engine cover.
Figure 3:
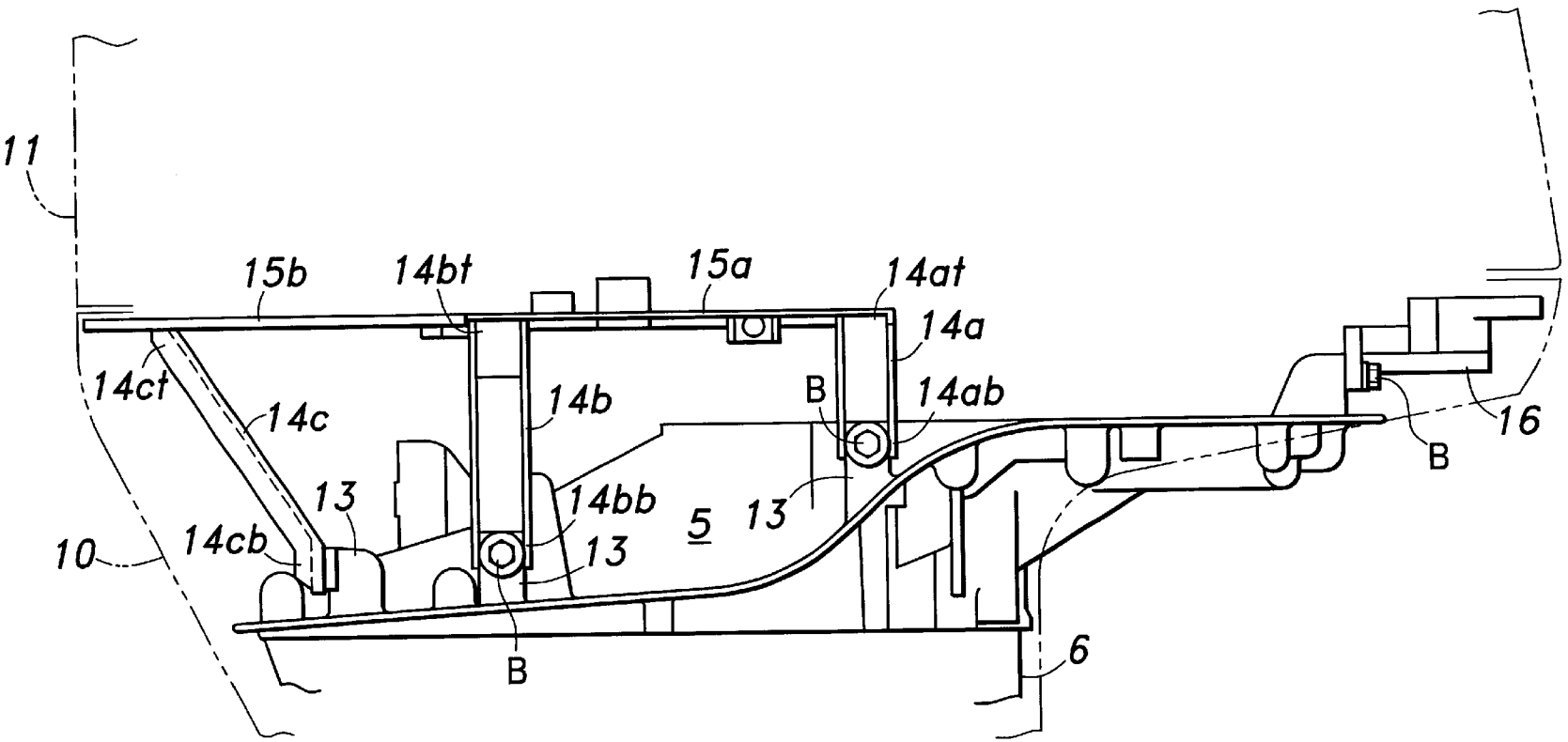
FIG. 3 is a simplified left side view of the mounting portions of the under cover and engine cover.

FIG. 2 is a top view of the outboard marine drive 1 of the present invention revealing the end surface for mounting the engine cover, and FIG. 3 is a left side view of the same. The orientation of the outboard marine drive is defined such that the lower end of FIG. 2 corresponds to the front. Referring to FIGS. 2 and 3, the engine mount case 5 made of die cast aluminum alloy is provided with six bosses 13 in an outer periphery of a rear part thereof, and the lower ends 14*ab* to 14*fb* of six upright stay members 14*a* to 14*f* made of metallic material such as steel are attached to the corresponding bosses 13 by using threaded bolts B each extending in a horizontal direction. The upper ends 14*at* to 14*ft* of these stay members 14*a* to 14*f* fixedly support under cover support rails 15*a* to 15*c*.

The under cover support rails 15*a* to 15*c* consist of three parts which are made of metallic material such as stamp formed steel members. The side parts 15*a* and 15*c* located on either side of the engine cover are integrally formed with side stay members 14*a* and 14*b*; and 14*e* and 14*f* in such a manner as to join the upper ends 14*at* and 14*bt*; and 14*et* and 14*ft* of the two side stay members 14*a* and 14*b*; and 14*e* and 14*f* to each other which are fixedly attached to either side of the engine mount case 5. The arch shaped rear part 15*b* is fixedly attached to the upper ends 14*ct* and 14*dt* of the two rear stay members 14*c* and 14*d* with threaded bolts B. The front part of the engine mount case 5 is provided with a front bracket 16 for supporting the under cover 10. The front bracket 16 is cast separately from the engine mount case 5 and fixedly attached to the front end of the engine mount case 5 with threaded bolts B. The right and left under cover support rails 15*a* and 15*c* are provided with an adequate mechanical strength to support the weight of the outboard marine drive 1 when it is placed on its side.

The under cover 10 whose upper open end is supported by these under cover support rails 15*a* to 15*c* is made of plastic material, and surrounds the lower part of the engine E and the part of the extension case 6 connected to the engine mount case 5. In the illustrated embodiments, the support rails 15*a* to 15*c* as well as the stay members 14*a* to 14*f* are made of metallic material, but may be made of plastic or other reinforced or non-reinforced materials that are provided with an adequate mechanical strength.

As components of the latching arrangement R for attaching the engine cover 11 made of plastic material to the upper open end of the under cover 10 which is also made of plastic material, four latch units 17*a* to 17*d* are provided, one on each of the side under cover support rails 15*a* and 15*c* connecting the side stay members 14*a* and 14*b*; and 14*e* and 14*f* of the corresponding side to each other, and two on the front bracket 16. By thus providing the latch units 17*a* to 17*d* forming components of the latching arrangement R on members that are made of metallic material, the reliance on the under cover 10 made of plastic material in ensuring the overall mechanical strength can be avoided.

The four latch units 17*a* to 17*d* are arranged in such a manner that the distance between the one 17*d* on the left side of the front bracket 16 and the one 17*a* on the left under cover support rail 15*a* is substantially equal to the distance between the one 17*c* on the right side of the front bracket 16 and the one 17*b* on the right under cover support rail 15*c*, and is also substantially equal to the distance between the ones 17*a* and 17*b* on the right and left under cover support rails 15*a* and 15*c*, respectively. By thus arranging the latching positions in an equilateral or isosceles triangular arrangement, two in the front as a single group and two on either side, the retaining force acting between the under cover 10 and the engine cover 11 can be made substantially uniform over the entire circumference.

Figure 4:
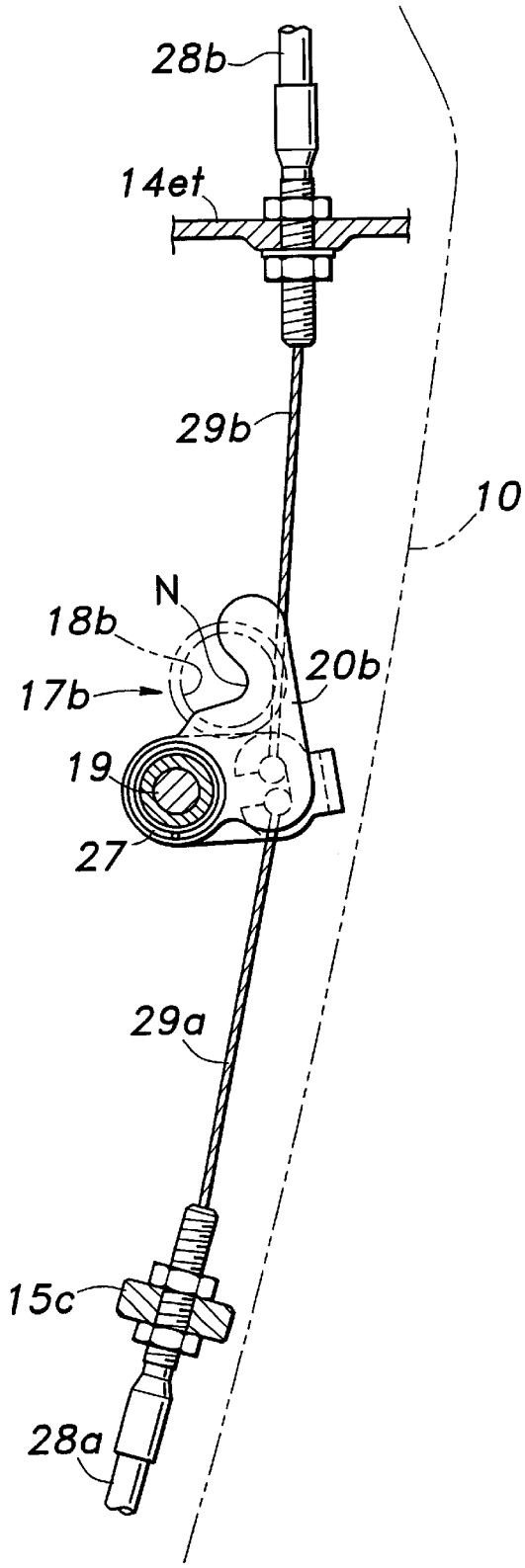
FIG. 4 is a top view of the rear latch unit.
Figure 5:
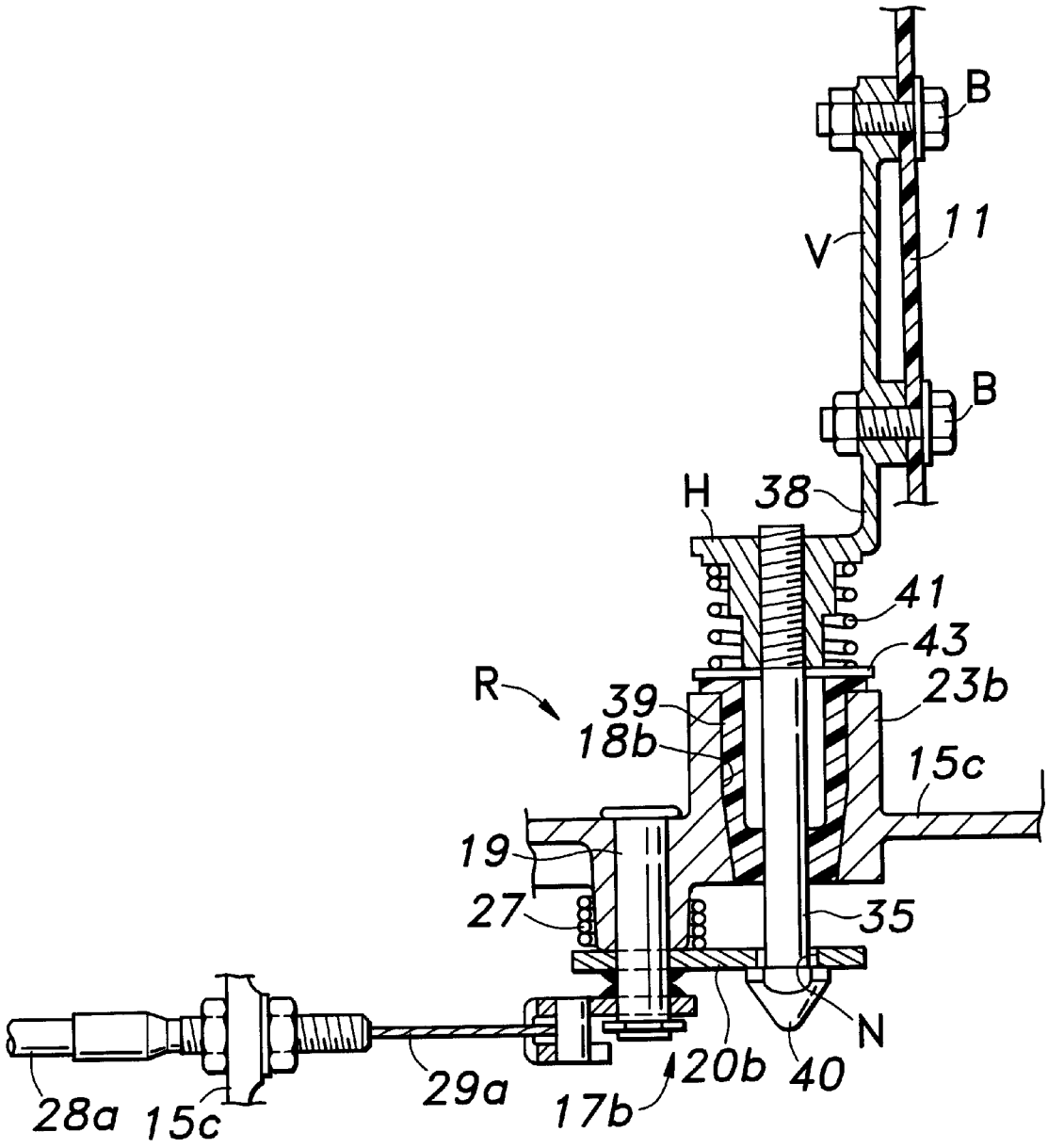
FIG. 5 is a vertical sectional view of the rear latch unit.

As shown in FIGS. 4 and 5, of these four latch units 17*a* to 17*d*, the ones 17*a* and 17*b* on either side each consist of a vertical hole 18*a* and 18*b* passed in a cylindrical collar 23*a* and 23*b* integrally formed in the corresponding under cover support rail 15*a* and 15*c*, and a latch plate 20*a* and 20*b* which is pivotally supported adjacent to the corresponding hole 18*a* and 18*b* by a vertical shaft 19 so as to be rotatable in a horizontal plane between a position interfering with the corresponding hole 18*a* and 18*b* and a position not interfering with the corresponding hole 18*a* and 18*b*. FIGS. 4 and 5 show only the right latch unit 17*b*, and the left latch unit 17*a* is identical to the right latch unit 17*b* except that they are mirror images of each other.

Figure 6:
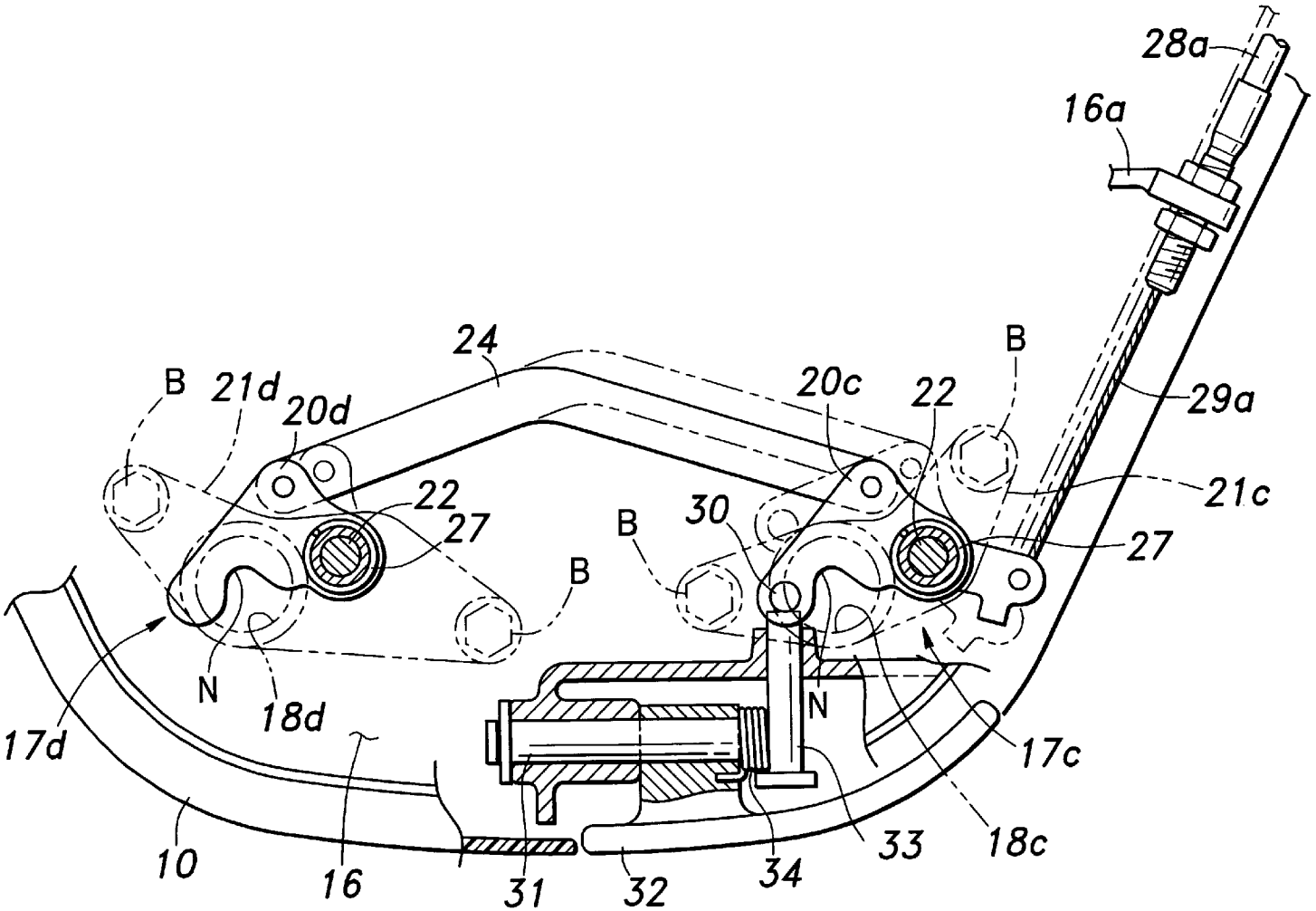
FIG. 6 is a top view of the front latch unit.
Figure 7:
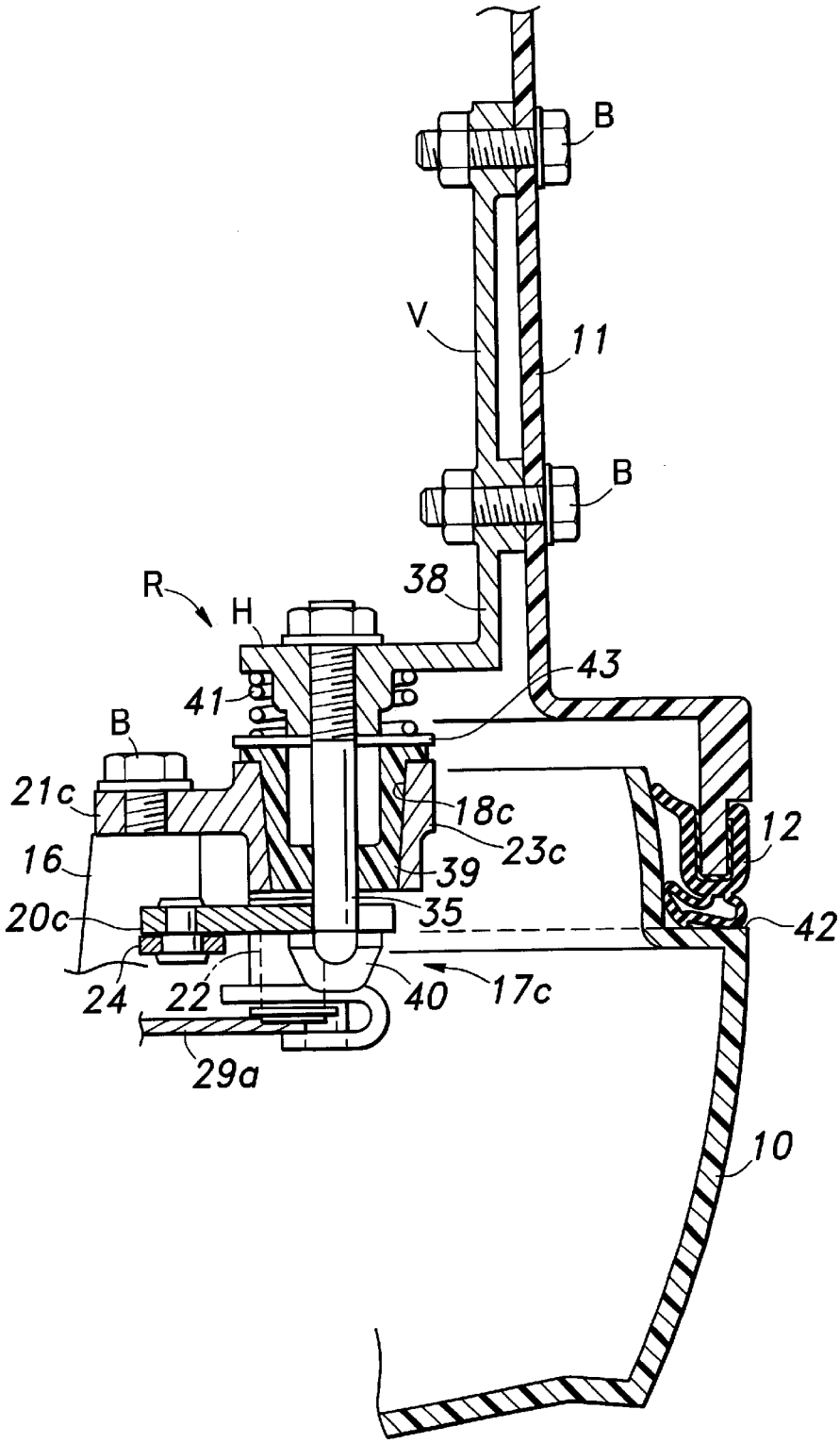
FIG. 7 is a vertical sectional view of the front latch unit.

As shown in FIGS. 6 and 7, the two front latch units 17*d* and 17*c* comprise a pair of holder members 21*d* and 21*c* each fixedly attached to the upper surface of the front bracket 16 with a pair of threaded bolts B, right and left latch plates 20*d* and 20*c* which are each pivotally supported by the corresponding holder member 21*d* and 21*c* with a vertical shaft 22, and a link member 24 made of steel plate punched out into a shape of a rod bent in the middle as seen from above and joining the right and left latch plates 20*d* and 20*c* with each other. Thus, the two latch units 17*d* and 17*c* form a single sub assembly by being connected to each other by the rigid link member 24.

A vertical hole 18*d* and 18*c* is formed a collar 23*d* and 23*c* integrally formed in each of the holder members 21*d* and 21*c* between the two fastening bolts B, and each latch plate 20*d* and 20*c* is pivotally supported adjacent to the corresponding hole 18*d* and 18*c* so as to be rotatable in a horizontal plane between a position interfering with the corresponding hole 18*d* and 18*c* and a position not interfering with the corresponding hole 18*d* and 18*c*.

Each of the four latch plates 20*a* to 20*d* mentioned above is resiliently urged by a torsion coil spring 27 so as to retain corresponding latch plate 20*a* to 20*d* in the position interfering with the corresponding hole 18*a* to 18*d* as long as no external force is applied thereto. Each of the latch plates 20*a* to 20*d* is provided with a notch N at a position corresponding to the center of the corresponding hole 18*a* to 18*d*.

The right front latch plate 20*c* on the front bracket 16 is provided with a connecting end for the inner cable 29*a* of a first Boden cable 28*a* at one end thereof, and a pin 30 for engaging a push rod (which is described hereinafter) at the other end thereof, on either side of the vertical shaft 22.

Figure 8:
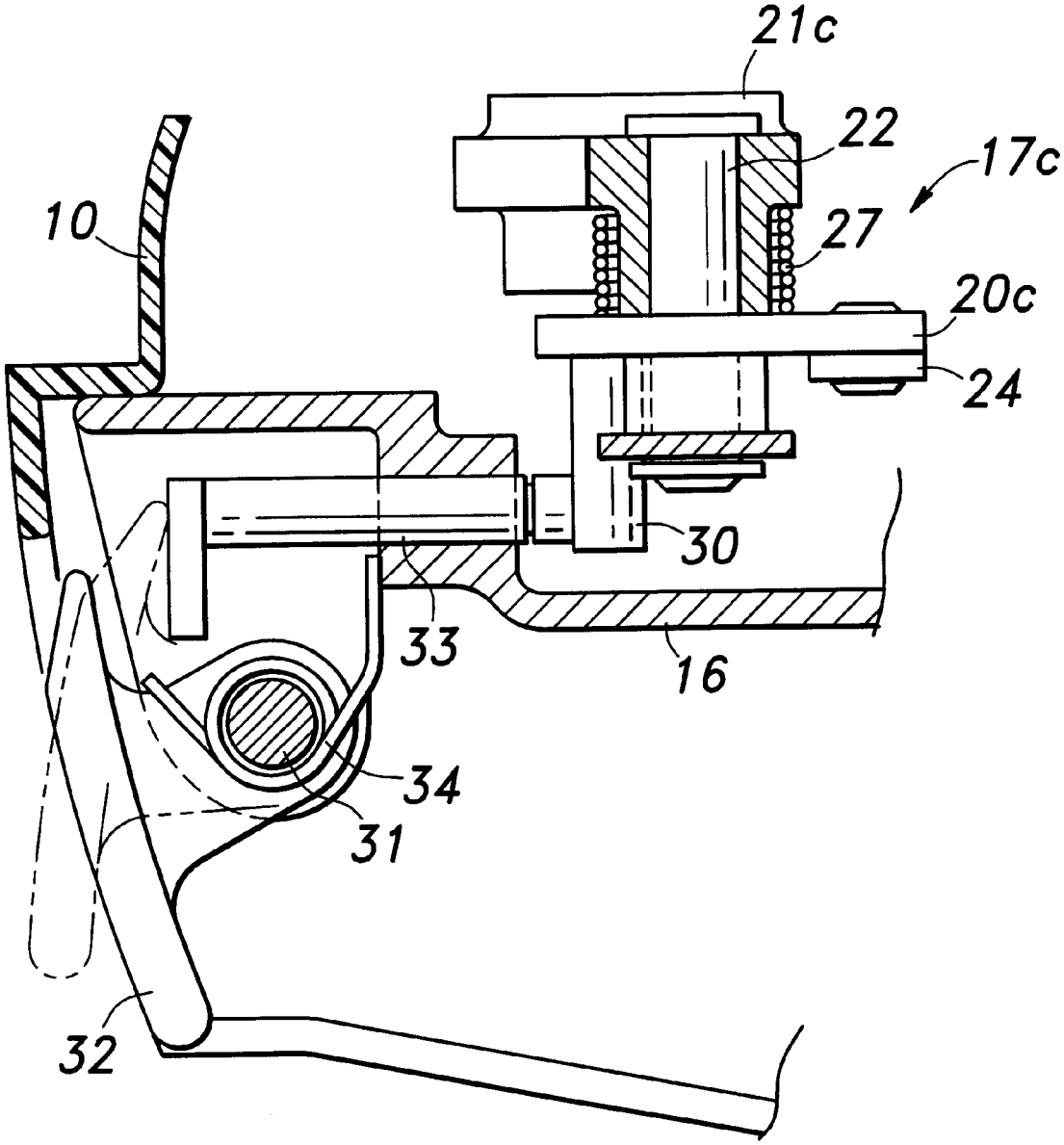
FIG. 8 is a vertical sectional view of the latch release mechanism.

As also shown in FIG. 8, the front end of the front bracket 16 is provided with a latch release lever 32 pivotally supported by a horizontal shaft 31, and a push rod 33 that can slide in the fore-and-aft direction. The latch release lever 32 has an upper end that can engage the front end of the push rod 33, and is normally urged by a torsion coil spring 34 in the direction to prevent the upper end of the latch release lever 32 from engaging the front end of the push rod 33 or away from the front end of the push rod 33.

When the latch release lever 32 is turned around the horizontal shaft 31 by pulling the lower end of the lock release lever 32 outward, the upper end thereof pushes the push rod 33 rearward. As a result, the pin 30 extending upright from the left end of the front right latch plate 20*c* is pushed rearward, causing the latch plate 20*c* to rotate around the vertical shaft pin 22. This in turn causes the left end of the latch plate 20*c* provided with the pin 30 to be moved rearward, and the right end thereof to be moved forward. Thus, the inner cable 29*a* of the first Boden cable 28*a* is pulled outward.

Meanwhile, the rotation of the front right latch plate 20*c* is transmitted to the front left latch plate 20*d* via the link member 24. As a result, the right and left latch plates 20*c* and 20*d* rotate by a same angle. This rotational movement causes the notch N of each latch plate which has been aligned with the center of the corresponding vertical hole 18*d* and 18*c* to be moved away from the corresponding hole 18*d* and 18*c*.

The front right latch plate 20*c* is connected to the rear right latch plate 20*b* of the rear right latch unit 17*b* via the first Boden cable 28*a*. The rear right latch plate 20*b* is connected to the rear left latch plate 20*a* of the rear left latch unit 17*a* via a second Boden cable 28*b*. The outer tubes of the first and second Boden cables 28*a* and 28*b* extending between the three latch plates are attached to a part 16*a* of the front bracket 16, a middle part of the right under cover support rail 15*c*, an upper end 14*et* of the rear right stay member 14*e*, and an upper end 14*bt* of the rear left stay member 14*b* so that the tension of the inner cables 29*a* and 29*b* of the first and second Boden cables 28*a* and 28*b* may be adjusted independently. Thus, the error in the synchronization between the two latch plates can be minimized. Because the outer tube of a Boden cable is highly flexible as well known in the art, the latch plates can be arranged at will.

The parts of the inner surface of the engine cover 11 corresponding to the holes 18*a* to 18*d* are provided with striker pins 35 as shown in FIGS. 5 and 7. Each striker pin 35 is attached, by threading, to a horizontal portion H of an L-shaped bracket 38 which is fixedly attached to the inner surface of the circumferential wall of the engine cover 11 at its vertical portion V, and is oriented vertically.

A damper bush 39 consisting of a tubular member made of elastomer and provided with an outer diameter which allows it to be fitted into the corresponding hole 18 is slidably fitted on a stem portion of each striker pin 35 via a washer 43. The free end of each striker pin 35 is integrally provided with a tapered enlarged diameter portion 40. A compression coil spring 41 is interposed between the lower surface of the horizontal portion H of each bracket 38 adjacent to the base end of the corresponding striker pin 35 and the upper surface of the damper bush 39 via the washer 43 to urge them away from each other.

When placing the engine cover 11 over the under cover 10, the striker pins 35 are fitted into the corresponding holes 18*a* to 18*d* provided in the under cover 10 while the engine cover 11 is placed over the engine E. When the damper bushes 39 are fitted into the holes 18*a* to 18*d* and the engine cover 11 is pushed further down, the striker pins 35 are lowered against the spring force of the compression coil springs 41. As the enlarged diameter portions 40 of the striker pins 35 reach the notches N of the corresponding latch plates 20*a* to 20*d*, the tapered enlarged diameter portions 40 push away the corresponding latch plates 20*a* to 20*d*. As the enlarged diameter portions 40 pass the corresponding notches N, the latch plates 20*a* to 20*d* are forced back to their original positions by the spring force of the torsion coil springs 27, and the notches N of the latch plates 20*a* to 20*d* engage the enlarged diameter portions 40 of the corresponding striker pins 35 with the result that the engine cover 11 is locked in place. At the same time, the seal rubber 11 provided along the open end of the engine cover 11 closely contacts the outer peripheral flange 42 of the under cover 10, and the engine room defined by the engine cover 11 and under cover 10 is sealed off. In this latched state, because the compression coil springs 41 disposed coaxially with respect to the corresponding striker pins 35 apply a force which urges the under cover 10 and engine cover 11 away from each other, the reaction force acting against the engagement force between the latch plates 20*a* to 20*b* and the striker pins 35 is not required to rely on the restoring force of the seal rubber 12.

During this latching process, when the engine cover 11 is pushed downward onto the under cover 10, the downward movement of the engine cover 11 is limited by the abutment between the horizontal portions H of the brackets 38 and the upper end of the collars 23*a* to 23*b* with the washers 43 and the rubber bushes 39 interposed between them. The rubber bushes 39, in cooperation with the compression coil springs 41, accommodate positional errors that may be present in the latch units, and provide a cushioning effect.

When the latch release lever 32 is pulled outward, all of the latch plates 20*a* to 20*d* connected to the link member 24 and the Boden cables 28*a* and 28*b* rotate in the direction to release the latch plates 20*a* to 20*d*. This causes the enlarged diameter portions 40 of the striker pins 35 to be disengaged from the corresponding notches N, and the engine cover 11 to be pushed upward by virtue of the spring force of the compression coil springs 41 provided on the striker pins 35 which is assisted by the restoring force of the seal rubber 12. This in turn causes the striker pins 35 to be moved upward, and the enlarged diameter portions 40 to be moved to such positions as to disable the notches N of the corresponding latch plates 20*a* to 20*d* from engaging the striker pins 35. Under this condition, because the latching arrangement R is entirely released, the engine cover 11 can be lifted while the damper bushes 39 are pushed away from the corresponding holes 18*a* to 18*d*.

Thus, according to the present invention described above, because the under cover covering a lower part of the engine is supported by a stay member made of metallic material, a required mechanical strength can be achieved while minimizing the increase in weight. In particular, the weight of the outboard marine drive when it is placed on its side can be supported by a side rail integrally formed with the stay member, and the latch unit for retaining the engine cover in a closed state can be provided in this part so that the supporting of the weight of the outboard marine drive and the retaining of the engine cover in a closed state can be accomplished without relying on the mechanical strength of the under cover. Therefore, the present invention allows both a light weight and an high mechanical strength to be achieved substantially without any compromise.

Although the present invention has been described in terms of a preferred embodiment thereof, it is obvious to a person skilled in the art that various alterations and modifications are possible without departing from the scope of the present invention which is set forth in the appended claims.

What is claimed is:

1. An outboard marine drive, comprising:

an internal combustion engine;

an engine mount case made of metallic material for supporting said engine;

an extension case depending from said engine mount case and accommodating at least a part of a power transmission unit therein;

an under cover made of plastic material for covering a lower part of said engine, said under cover having a lower end attached to an upper end of said engine mount case and an open upper end;

an engine cover made of plastic material for covering an upper part of said engine, said engine cover having a substantially enclosed upper end and an open lower end which is adapted to engage said open upper end of said under cover to jointly define an engine room; and a stay member fixedly attached to a part supporting said engine and provided with an upper end disposed adjacent to an upper end of said under cover.

2. An outboard marine drive according to claim 1, wherein said stay member is made of metallic material.

3. An outboard marine drive according to claim 1, wherein said stay member is securely attached to said engine mount case at a lower end thereof.

4. An outboard marine drive according to claim 1, wherein said stay member includes at least two substantially upright members extending substantially upright along an inner surface of said under cover, and a support rail is integrally attached to upper ends of said upright members and extending along an upper edge of said under cover.

5. An outboard marine drive according to claim 4, wherein said support rail extends substantially straight along an inner surface of a side of said under cover, and is integrally attached to the upper ends of said upright members.

6. An outboard marine drive according to claim 5, wherein said upright members and support rail provide an adequate mechanical strength to support said outboard marine drive when said outboard marine is placed on a corresponding side thereof.

7. An outboard marine drive according to claim 4, wherein said support rail extends in an arcuate manner along a rear part of said under cover so as to conform to an inner profile of said under cover, and said support rail extend between upper ends of said upright members.

8. An outboard marine drive according to claim 1, wherein a part of a latch unit for retaining said engine cover in a closed state is integrally formed with said stay member.

9. An outboard marine drive according to claim 8, wherein said latch unit is provided with an abutting part for engaging a corresponding abutting part of said engine cover or a striker attached to said engine cover for defining a closed position of said engine cover.

10. An outboard marine drive according to claim 9, wherein a resilient member is interposed between said abutting parts of said latch unit and said striker or said engine cover.

11. An outboard marine drive, comprising:

an internal combustion engine;

an engine mount case made of metallic material for supporting said engine;

an extension case depending from said engine mount case and accommodating at least a part of a power transmission unit therein;

an engine cover made of plastic material for covering an upper part of said engine, said engine cover having a substantially enclosed upper end and an open lower end which is adapted to engage an outer periphery of said engine mount case to jointly define an engine room; and at least a pair of strikers provided in a lower end of said engine cover;

a corresponding number of latch units provided in parts of said engine mount case corresponding to said strikers, each of said latch units including a latch plate provided on said engine mount case for rotation in a substantially horizontal plane between a position for engaging a corresponding one of said strikers and a position for disengaging said striker; and a link member having a first end pivotally connected to the latch plate of one of said latch units and a second end pivotally connected to the latch plate of a different one of said latch units so that the latch plate of the one latch unit causes a like movement of the latch plate of the different latch unit for a synchronized actuation of said latch units.

12. An outboard marine drive according to claim 11, further comprising an under cover having a lower end attached to said engine mount case, and an upper open end adapted to engage said open lower end, and a stay member having an upper end located adjacent to said open upper end of said under cover, at least one of said latch units being mounted to said upper end of said stay member.

13. An outboard marine drive according to claim 11, wherein said latch unit is provided with an abutting part for engaging a corresponding abutting part of said striker or said engine cover for defining a closed position of said engine cover.

14. An outboard marine drive according to claim 13, wherein a resilient member is interposed between said abutting parts of said latch unit and said striker or said engine cover.

15. An outboard marine drive, comprising:

an internal combustion engine;

an engine mount case made of metallic material for supporting said engine;

an extension case depending from said engine mount case and accommodating at least a part of a power transmission unit therein;

an engine cover made of plastic material for covering an upper part of said engine, said engine cover having a substantially enclosed upper end and an open lower end which is adapted to engage an outer periphery of said engine mount case to jointly define an engine room; and at least three strikers provided in a lower end of said engine cover;

a corresponding number of latch units provided in parts of said engine mount case corresponding to said strikers, each of said latch units including a latch plate provided on said engine mount case for rotation between a position for engaging a corresponding one of said strikers and a position for disengaging said striker; and at least a first cable and a second cable, said first cable having one end connected to the latch plate of a first one of said latch units and an opposite end connected to the latch plate of a second one of said latch units, and said second cable having one end connected to the latch plate of the second latch unit and an opposite end connected to the latch plate of the third latch unit, the cables being guided along a inner peripheral part of said engine mount case.

16. An outboard marine drive according to claim 15, further comprising an under cover having a lower end attached to said engine mount case, and an upper open end adapted to engage said open lower end, and a stay member having an upper end located adjacent to said open upper end of said under cover, at least one of said latch units being mounted to said upper end of said stay member.

17. An outboard marine drive according to claim 15, wherein said latch unit is provided with an abutting part for engaging a corresponding abutting part of said striker or said engine cover for defining a closed position of said engine cover.

18. An outboard marine drive according to claim 17, wherein a resilient member is interposed between said abutting parts of said latch unit and said striker or said engine cover.

* * * * *